US005464332A

United States Patent [19]

Beck et al.

[11] Patent Number: 5,464,332

[45] Date of Patent: Nov. 7, 1995

[54] COMPRESSOR WITH MOTOR COOLING FAN

[75] Inventors: Norman G. Beck; Frank S. Wallis; Gary A. Holthaus, all of Sidney, Ohio

[73] Assignee: Copeland Corporation, Sidney, Ohio

[21] Appl. No.: 267,850

[22] Filed: Jun. 29, 1994

Related U.S. Application Data

[63] Continuation of Ser. No. 2,809, Jan. 11, 1993, abandoned.

[51] Int. Cl.[6] ..... F04B 17/00

[52] U.S. Cl. ..... 417/368; 417/902

[58] Field of Search ..... 417/902, 366, 417/368, 371; 310/62, 63, 58, 59; 418/101

[56] References Cited

U.S. PATENT DOCUMENTS

| | | | |
|---|---|---|---|
| Re. 32,027 | 11/1985 | Hyatt et al. | 417/368 |
| 2,324,434 | 7/1943 | Shore | 230/139 |
| 2,738,919 | 3/1956 | Rusch et al. | 230/58 |
| 2,844,302 | 7/1958 | Weibel, Jr. | 230/58 |
| 2,959,068 | 11/1960 | Doeg | 74/579 |
| 3,169,696 | 2/1965 | Warner | 230/207 |
| 3,176,914 | 4/1965 | Rinehart | 230/207 |
| 3,618,337 | 11/1971 | Mount | 62/505 |
| 3,761,748 | 9/1973 | Baumann et al. | 310/58 |
| 3,897,178 | 7/1995 | Palloch | 417/368 |
| 4,399,379 | 8/1983 | Marks et al. | 310/62 |
| 4,412,791 | 11/1983 | Lal | 417/366 |
| 4,488,855 | 12/1984 | Butterworth et al. | 417/368 |
| 4,717,316 | 1/1988 | Muramatsu et al. | 417/372 |
| 4,762,471 | 8/1988 | Asanuma et al. | 417/372 |
| 4,836,755 | 6/1989 | Nitsche et al. | 417/368 |
| 5,137,434 | 8/1992 | Wheeler et al. | 417/368 |

*Primary Examiner*—Richard A. Bertsch
*Assistant Examiner*—William Wicker
*Attorney, Agent, or Firm*—Harness, Dickey & Pierce

[57] ABSTRACT

A hermetically sealed compressor has a fan for cooling the motor of the compressor. The compressor utilizes the refrigerant vapor inside the hermetic shell to cool the motor. The fan is attached to the end of the motor rotor and crankshaft to circulate the suction gas of the compressor around and through the motor rotor and motor stator to absorb heat and then directs the suction gas against the hermetic shell in a spiralling motion for transferring heat to the shell which in turn transfers heat to the atmosphere.

17 Claims, 4 Drawing Sheets

COMPRESSOR WITH MOTOR COOLING FAN

This is a continuation of U.S. patent application Ser. No. 08/002,809, filed Jan. 11, 1993 now abandoned.

BACKGROUND AND SUMMARY OF THE INVENTION

The present invention relates to hermetically sealed compressors. More particularly the present invention relates to hermetically sealed refrigerant compressors incorporating unique motor cooling means to significantly increase the compressor's efficiency.

In the case of hermetically sealed refrigerant compressors used for refrigeration, air conditioning and/or heat pump applications, a re-occurring problem has been providing adequate motor cooling and maximizing compressor efficiency. Various arrangements have been employed to cool the electric motors of hermetically sealed refrigerant compressors by the use of the refrigerant itself. In some instances, the motor casing has been supplied with refrigerant vapor. In other arrangements, liquid refrigerant is directed onto the motor components. Although the refrigerant in the liquid state is capable of removing a great deal more heat from the motor than the refrigerant in the gaseous state, the arrangements employing the liquid refrigerant are costly and the possibility may arise that the liquid refrigerant, or an adequate supply thereof, may not be available.

Accordingly, what is needed is an improved method of motor cooling which is inexpensive, relatively simple in construction and does not result in a significant loss of energy.

The present invention provides the art with a means for cooling the motor of a hermetically sealed compressor assembly by utilizing the refrigerant vapor and providing a means to efficiently circulate the vapor within the sealed chamber to enhance its cooling effect. The present invention incorporates a uniquely configured fan which is attached to the end of the crankshaft of the motor rotor. The fan circulates the refrigerant vapor around and through the motor rotor and stator and then directs the flow against the inside surface of the hermetic shell in a spiraling manner to effectively transfer heat from the motor to the shell from which it can be transferred to the atmosphere.

From the subsequent detailed description, appended claims and drawings, other objects and advantages of the present invention will become apparent to those skilled in the art.

DESCRIPTION OF THE DRAWINGS

In the drawings which illustrate the best mode presently contemplated for carrying out the present invention.

DESCRIPTION OF THE PREFERRED EMBODIMENT

Hermetically sealed motor compressors of various designs are well known in the art. These designs include both the reciprocating piston types and rotary types. While the present invention applies equally well to all of the various designs of motor compressor units, it will be described for exemplary purposes embodied in a hermetically sealed reciprocating piston type fluid machine.

Figure 1:
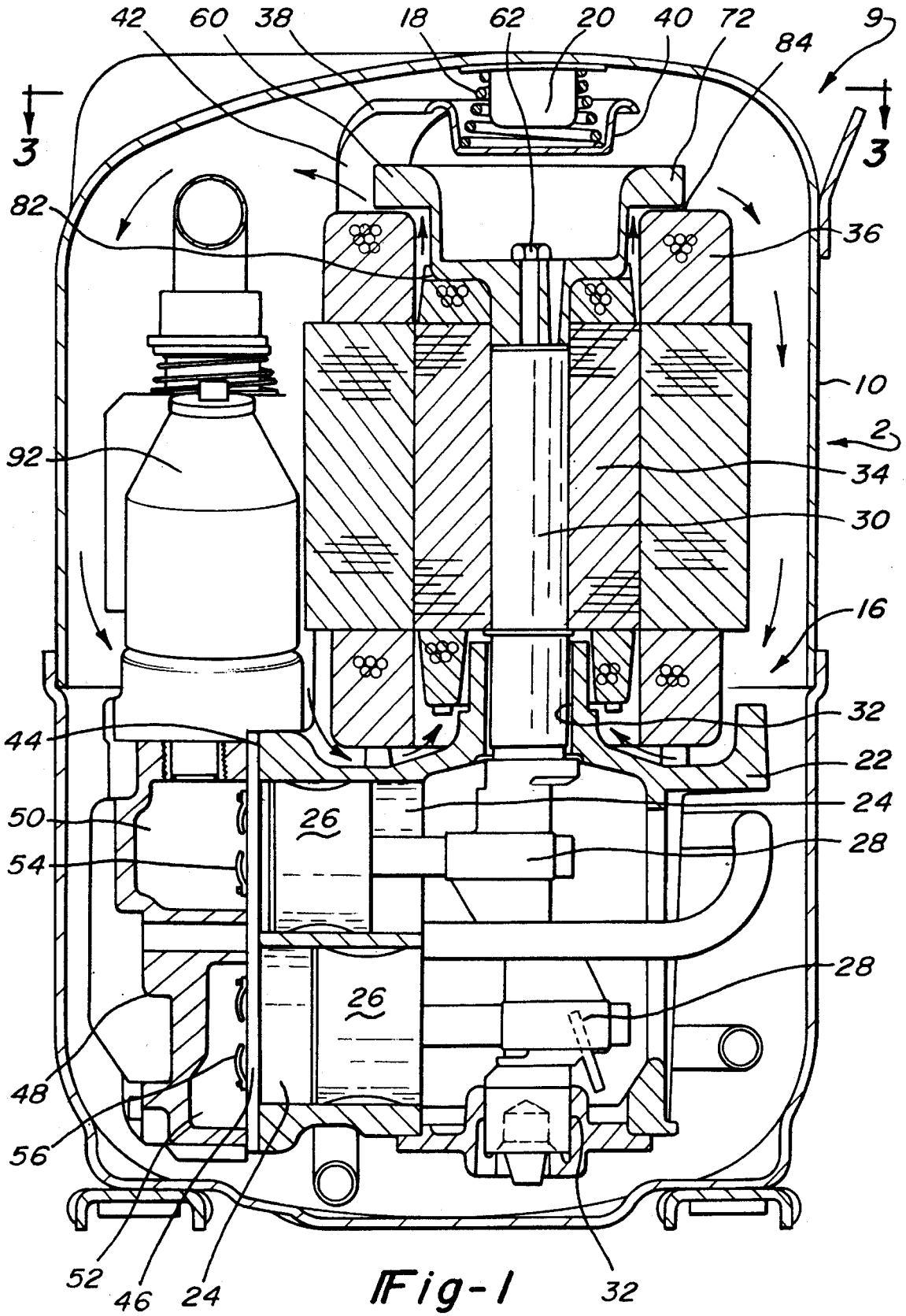
FIG. 1 is a vertical side view partially in cross section of a multi-cylinder hermetic refrigerant compressor incorporating an internal fan embodying the principles of the present invention.
Figure 2:
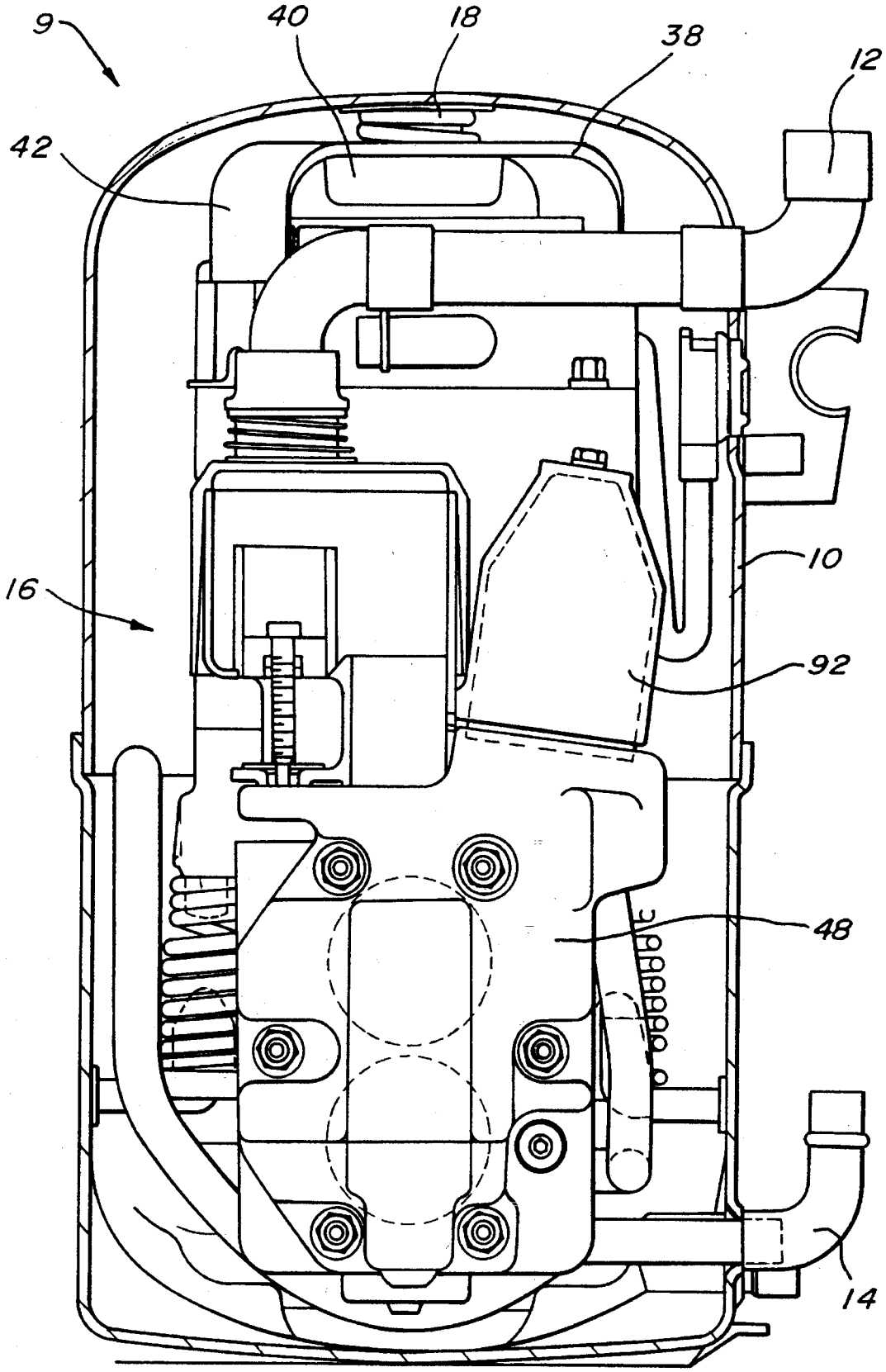
FIG. 2 is a vertical side view partially in cross section taken in the direction of Arrow 2 of FIG. 1.
Figure 3:
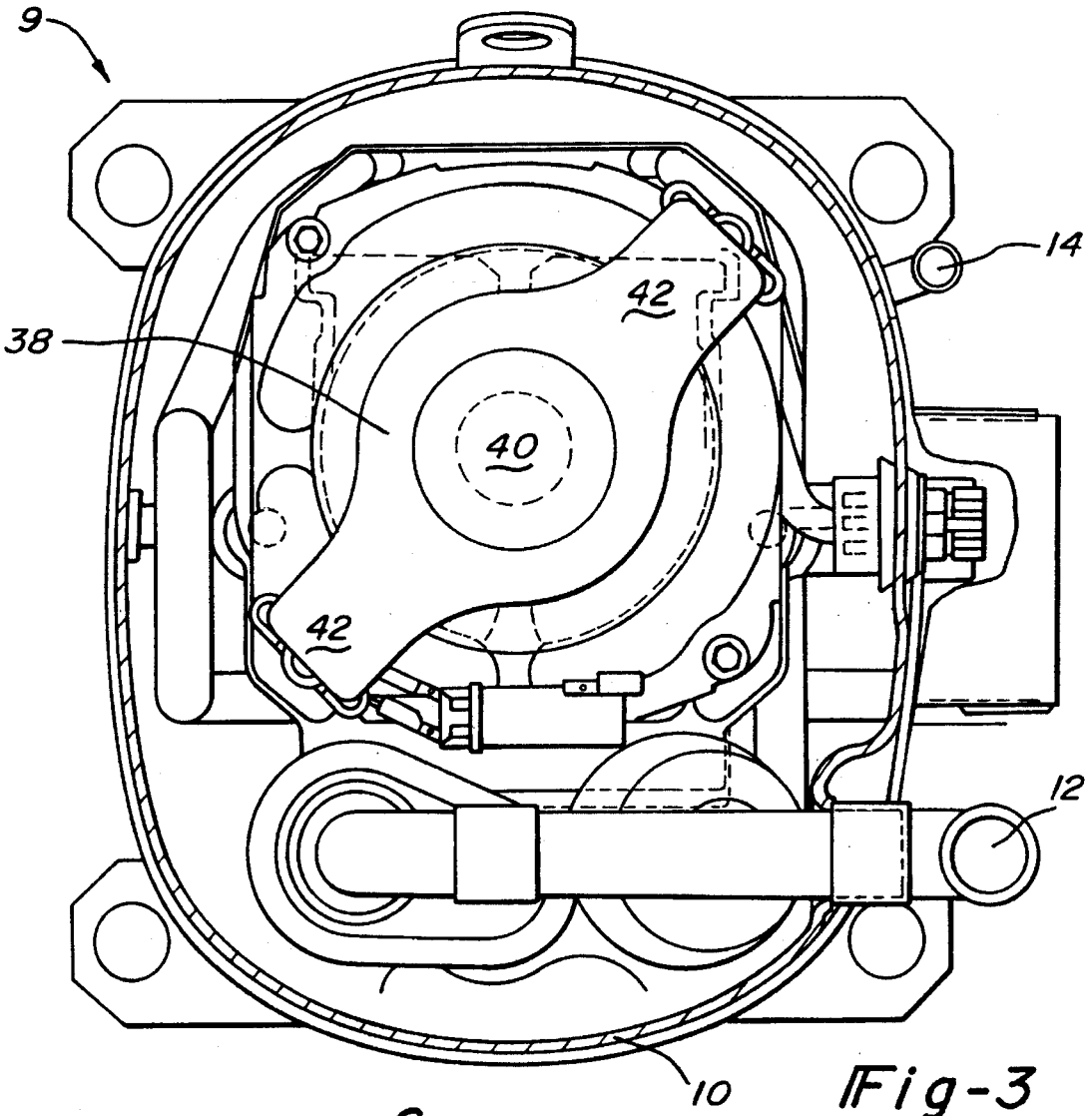
FIG. 3 is a top view of the multi-cylinder hermetic refrigerant compressor taken along line 3—3 of FIG. 1.

Referring now to the drawings in which like reference numerals designate like or corresponding parts through the several views, there is shown in FIGS. 1 through 3 a compressor 9 in accordance with the present invention. Compressor 9 includes a hermetic shell 10, a suction gas inlet fitting 12, a discharge fitting 14, and a motor compressor unit 16 disposed within hermetic shell 10. Motor compressor unit 16 is spring supported in the usual manner and positioned at the upper end of hermetic shell 10 by means of a spring 18 located on a sheet metal projection 20. Motor compressor unit 16 generally comprises a compressor body 22 defining a plurality of pumping cylinders 24 (two parallel radially disposed cylinders in the embodiment shown in FIGS. 1 and 2). A reciprocating pumping member is disposed in each of these cylinders in the form of a piston 26 connected in the usual manner by connecting rod 28 to a crankshaft 30. Each cylinder 24 in body 22 is opened to an outer planar surface 44 on body 22 to which is bolted the usual valve plate assembly 46 and cylinder head 48 all in the usual manner. Cylinder head 48 defines interconnected discharge chambers 50 and 52 which receive the discharge gas pumped by compressor 9 through discharge valve assemblies 54 and 56 respectfully. Up to this point the compressor as described is known in the art and the essential details thereof are disclosed in Assignee's U.S. Pat. No. 4,412,791, the disclosure of which is hereby incorporated herein by reference.

The lower end of crankshaft 30 is rotationally journalled in a bearing 32 disposed in body 22. The upper end of crankshaft 30 is affixed to a motor rotor 34 rotatively disposed within a motor stator 36. The upper end of motor stator 36 is provided with a motor cover 38 which has a recess 40 for receiving spring 18. Motor cover 38 is fixedly attached to motor stator 36 by a pair of legs 42. The motor fan 60 of the present invention is shown in FIG. 1 and is fixedly attached to the upper end of crankshaft 30 by a single bolt 62. Motor fan 60 is shown in greater detail in FIGS. 4 through 6.

Figure 4:
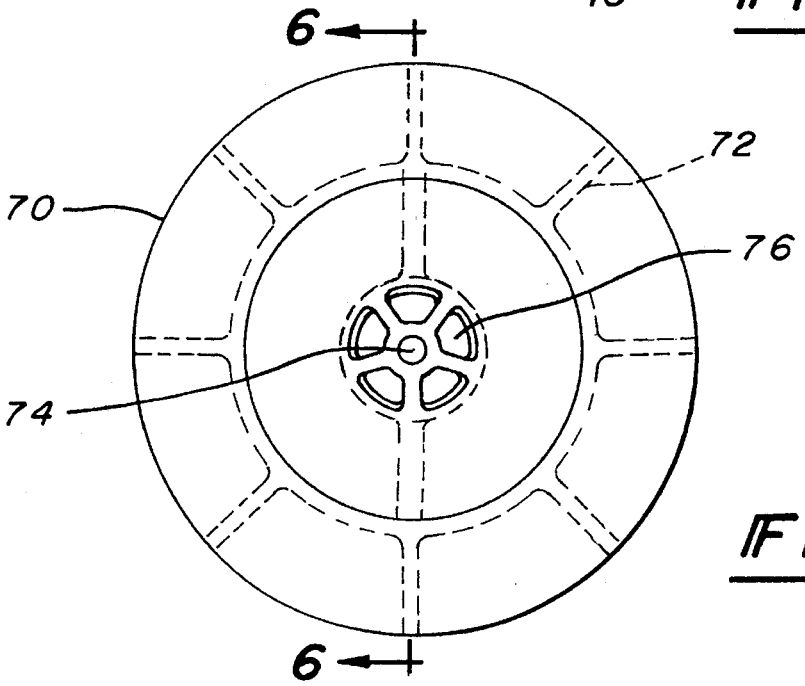
FIG. 4 is a top plan view of the fan of the present invention.
Figure 5:
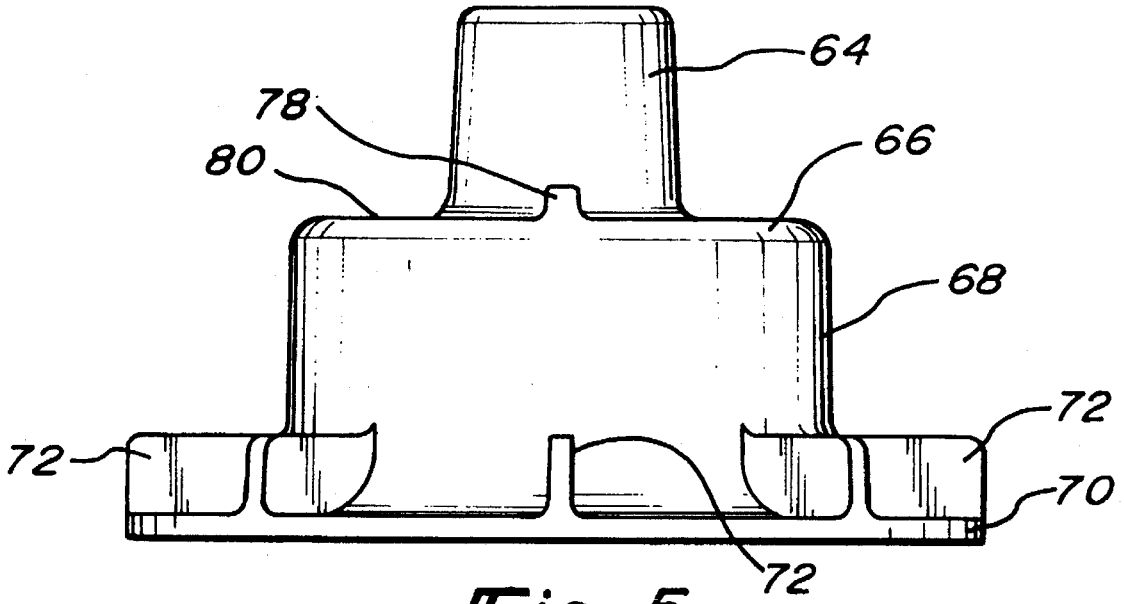
FIG. 5 is a side view showing the fan of the present invention.
Figure 6:
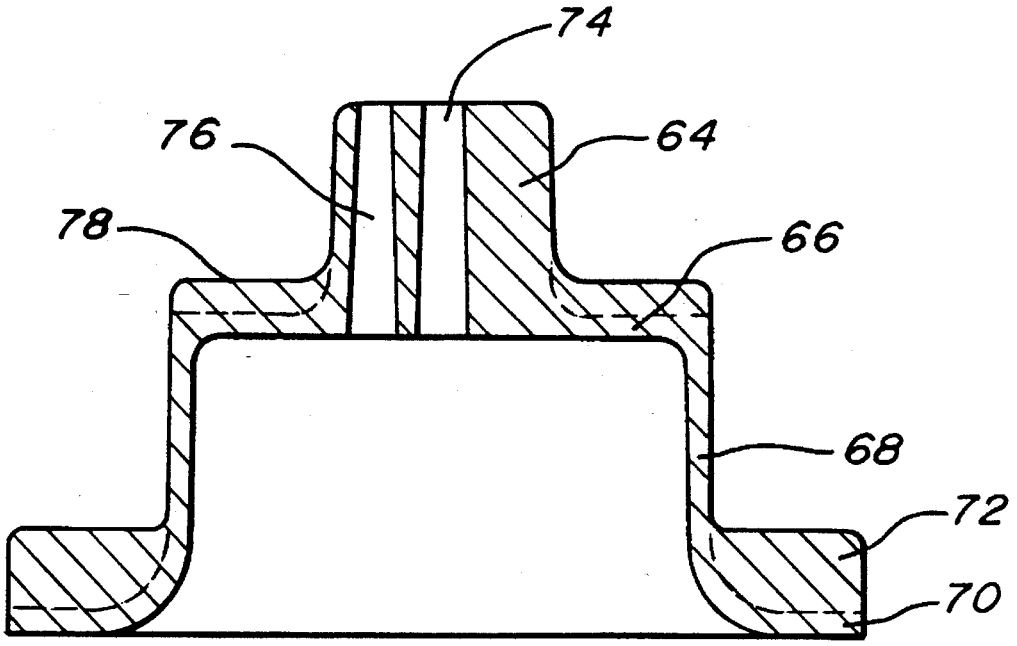
FIG. 6 is a side view partially in cross-section of the fan of the present invention taken along line 6—6 of FIG. 4.

Motor fan 60 comprises a cylindrical section 64, a first flange 66, an annular section 68, a second flange 70 and a plurality of fan blades 72. Cylindrical section 64 defines a cylindrical bore 74 extending axially through the center of cylindrical section 64 for accommodating fastening bolt 62 to provide for the attaching of motor fan 60 to crankshaft 30. A plurality of circumferentially spaced material reduction apertures 76 are positioned radially outward from cylindrical bore 74 as shown in FIGS. 4 and 6. First flange 66 extends radially outward from one end of cylindrical section 64. A plurality of circumferentially spaced driving tabs 78 extend both axially from first flange 66 and radially outward from cylindrical section 64 as shown in FIGS. 4–6. Driving tabs 78 engage corresponding slots 82 provided in motor rotor 34 to provide positive engagement for driving motor fan 60.

Annular section 68 extends axially from the exterior surface of outwardly extending flange 66 in a direction opposite to that of cylindrical section 64. Second flange 70 extends radially outward from the open end of annular section 68. The plurality of fan blades 72 are circumferentially spaced around second flange 70 and extend both axially from flange 70 and radially from annular section 68 as shown in FIGS. 4–6.

Motor fan 60 is bolted to the upper end of crankshaft 30 by bolt 62 such that the outer diameter of cylindrical section 64 becomes piloted by the internal diameter of motor rotor 34 to guide and center motor fan 60 within motor stator 36. The outer surface 80 of first flange 66 abuts the upper portion of motor rotor 34 as shown in FIG. 1. At least one of the axially extending driving tabs 78 is located within a respective slot 82 provided in the upper end of motor rotor 34. Second flange 70 extends outward from annular section 68 and is located above motor stator 36. Fan blades 72 extend down from second flange 70 towards motor stator 36. Motor fan 60 is designed such that a predetermined gap 84 is maintained between fan blades 72 and motor stator 36. Gap 84 is maintained at a specified dimension to minimize the power needed to operate motor fan 60 by maintaining a low mass flow and to insure that motor fan 60 will not interfere with the windings.

During operation of the motor compressor, motor fan 60 rotates with crankshaft 30 and motor rotor 34. The lower pressured suction gas which is contained within hermetic shell 10 is forced by motor fan 60 to circulate within the inside of the hermetic shell as shown by the arrows in FIG. 1. The suction gas begins at the bottom of motor rotor 34 and motor stator 36. The suction gas is drawn through the opening between motor rotor 34 and motor stator 36 by motor fan 60. During the movement through this opening, the suction gas absorbs heat generated by the motor. Motor fan 60 then directs this higher temperature suction gas outward towards and against the inside surface of hermetic shell 10 in a spiraling manner. The higher temperature suction gas contacts the inside surface of shell 10 and turns and spirals downward along the inside surface of shell 10 and is cooled by the contact with shell 10. Shell 10 is surrounded by ambient air on its exterior surface and thus transfers the heat to the ambient air. The spiraling effect caused by motor fan 60 increases the amount of heat which will be transferred to outer shell 10 and thence to the atmosphere. When the cooled suction gas reaches the lower portion of shell 10, motor fan 60 again draws it up through the opening between motor rotor 34 and motor stator 36 and the cycle begins again.

The embodiment shown in FIGS. 1 through 3 utilizes an optional discharge muffler heat shield 92. Heat shield 92 provides an area surrounding the discharge muffler which uses a dead suction gas space to minimize the amount of compressor heat that is transferred to the suction gas which is being circulated by motor fan 60. Without heat shield 92, the circulated suction gas would pick up heat from both the discharge muffler and the motor thus limiting the amount of cooling capabilities of the circulating suction gas.

While the above detailed description describes the preferred embodiments of the present invention, it should be understood that the present invention is susceptible to modification, variation and alteration without deviating from the scope and fair meaning of the subjoined claims.

What is claimed is:

1. A hermetic compressor for a refrigerant comprising:

a hermetically sealed outer shell;

motor means disposed within said shell, said motor means including a motor stator fixedly secured to said shell, a motor rotor rotatably disposed within said motor stator and a driveshaft fixedly secured to said motor rotor;

compressor means disposed within said shell, said compressor means drivingly connected to said driveshaft of said motor means;

fan means fixedly secured to said driveshaft of said motor means and piloted by said motor rotor, said fan means operable to draw said refrigerant between said motor rotor and said motor stator such that heat is absorbed by said refrigerant, said fan means further operable to direct said refrigerant heated by said motor rotor and said motor stator against the interior surface of said outer shell in order to transfer said heat to said outer shell.

2. The compressor of claim 1 wherein said refrigerant is suction gas being supplied to said compressor means.

3. The compressor of claim 1 wherein said compressor means comprises a reciprocating piston compressor having a crankshaft, said crankshaft fixedly attached to said driveshaft for rotation therewith.

4. The compressor of claim 1 wherein said fan means and said motor stator define a gap between them; said gap being sized to allow a specific quantity of refrigerant to be pumped by said fan means.

5. The compressor of claim 1 wherein said fan means comprises a fan fixedly attached to said motor rotor for rotation therewith.

6. The compressor of claim 5 wherein said fan directs said refrigerant against the interior of said outer shell in a spiral motion.

7. The compressor of claim 5 wherein said fan is made of plastic.

8. The compressor of claim 1 wherein said fan is made of metal.

9. A hermetic compressor comprising:

an outer hermetic shell filled with a suction gas;

a motor stator supported within said outer hermetic shell;

a motor rotor rotatably disposed within said motor stator;

a reciprocating piston compressor disposed within said shell, said reciprocating piston compressor having a crankshaft, said motor rotor drivingly connected to said crankshaft;

a fan fixedly attached to said crankshaft, said fan being piloted by and rotating with said motor rotor such that said suction gas is circulated between said motor rotor and said motor stator and against the interior of said outer hermetic shell in order to absorb heat from said motor rotor and said motor stator and transfer said heat to said hermetic shell.

10. The compressor of claim 9 wherein said fan and said motor stator define a gap between them, said gap being sized to allow a specific quantity of suction gas to be pumped by said fan.

11. The hermetic compressor of claim 9 wherein said fan is made of plastic.

12. The hermetic compressor of claim 9 wherein said fan is made of metal.

13. A hermetic compressor for a refrigerant comprising:

a hermetically sealed outer shell;

motor means disposed within said shell, said motor means including a motor stator fixedly secured to said shell, a motor rotor rotatably disposed within said motor stator and a driveshaft fixedly secured to said motor rotor;

compressor means disposed within said shell, said rotary compressor means drivingly connected to said driveshaft of said motor means;

fan means having a plurality of radially extending blades fixedly secured to said driveshaft of said motor means and piloted by said motor rotor, said fan means operable to draw said refrigerant between said motor rotor and said motor stator such that heat is absorbed by said refrigerant, said fan means further operable to direct said refrigerant heated by said motor rotor and said motor stator against the interior surface of said outer shell.

14. The compressor of claim 13 wherein said refrigerant is suction gas being supplied to said rotary compressor means.

15. The compressor of claim 13 wherein said fan means comprises a fan fixedly attached to said motor rotor for rotation therewith.

16. The compressor of claim 14 wherein said compressor means comprises a reciprocating piston compressor having a crankshaft, said crankshaft fixedly attached to said driveshaft for rotation therewith.

17. The compressor of claim 14 wherein said fan means and said motor stator define a gap between them; said gap being sized to allow a specific quantity of refrigerant to be pumped by said fan means.

* * * * *

UNITED STATES PATENT AND TRADEMARK OFFICE

CERTIFICATE OF CORRECTION

PATENT NO. : 5,464,332

DATED : November 7, 1995

INVENTOR(S) : Norman G. Beck; Frank S. Wallis; Gary A. Holthaus

It is certified that error appears in the above-indentified patent and that said Letters Patent is hereby corrected as shown below:

Column 4, line 34, "1" should be — 5 —.

Column 6, line 4, "14" should be — 13 —.

Column 6, line 9, "14" should be — 13 —.

Signed and Sealed this

Twenty-third Day of April, 1996

Bruce Lehman

*Attest:*

BRUCE LEHMAN

*Attesting Officer*

*Commissioner of Patents and Trademarks*